US006322365B1

(12) United States Patent
Shechter et al.

(10) Patent No.: US 6,322,365 B1
(45) Date of Patent: Nov. 27, 2001

(54) NETWORK-LINKED LASER TARGET FIREARM TRAINING SYSTEM

(75) Inventors: Motti Shechter, Potomac; Stephen P. Rosa, Ellicott City, both of MD (US)

(73) Assignee: Beamhit, LLC, Columbia, MD (US)

( * ) Notice: Subject to any disclaimer, the term of this patent is extended or adjusted under 35 U.S.C. 154(b) by 0 days.

(21) Appl. No.: 09/486,342

(22) PCT Filed: Aug. 25, 1998

(86) PCT No.: PCT/US98/17419

§ 371 Date: Feb. 25, 2000

§ 102(e) Date: Feb. 25, 2000

(87) PCT Pub. No.: WO99/10700

PCT Pub. Date: Mar. 4, 1999

Related U.S. Application Data

(60) Provisional application No. 60/056,937, filed on Aug. 25, 1997.

(51) Int. Cl.[7] ..... F41G 3/26

(52) U.S. Cl. ..... 434/21; 434/19; 463/51

(58) Field of Search ..... 434/11, 16, 19–23, 434/219, 365; 463/5, 51; 362/8, 102, 111, 187, 259, 276, 553, 802; 361/232; 372/25; 455/39, 73; 42/1.16, 7, 50, 114, 116

(56) References Cited

U.S. PATENT DOCUMENTS

| | | | |
|---|---|---|---|
| 2,023,497 | | 12/1935 | Trammell . |
| 2,934,634 | | 4/1960 | Hellberg . |
| 3,633,285 | | 1/1972 | Sensney . |
| 3,792,535 | | 2/1974 | Marshall et al. . |
| 3,938,262 | | 2/1976 | Dye et al. . |
| 3,995,376 | | 12/1976 | Kimble et al. . |
| 4,048,489 | | 9/1977 | Giannetti . |
| 4,102,059 | | 7/1978 | Kimble et al. . |
| 4,195,422 | | 4/1980 | Budmiger . |
| 4,336,018 | | 6/1982 | Marshall et al. . |
| 4,352,665 | * | 10/1982 | Kimble et al. ..... 434/22 |
| 4,367,516 | | 1/1983 | Jacob . |
| 4,452,458 | | 6/1984 | Timander et al. . |
| 4,553,943 | | 11/1985 | Ahola et al. . |
| 4,592,554 | | 6/1986 | Gilbertson . |
| 4,640,514 | | 2/1987 | Myllylä et al. . |
| 4,662,845 | | 5/1987 | Gallagher et al. . |
| 4,737,106 | | 4/1988 | Laciny . |
| 4,761,907 | | 8/1988 | De Bernardini . |
| 4,786,058 | | 11/1988 | Baughman . |

(List continued on next page.)

FOREIGN PATENT DOCUMENTS

| | | | |
|---|---|---|---|
| 3537323 A | | 4/1987 | (DE) . |
| 3631081 A1 | | 3/1988 | (DE) . |
| 285-586A | | 10/1988 | (EP) . |
| 2-101398-A | * | 4/1990 | (JP) . |
| 1817825 A3 | | 5/1993 | (SU) . |
| WO 92/08093 | | 5/1992 | (WO) . |
| WO 94/03770 | | 2/1994 | (WO) . |

*Primary Examiner*—Joe H. Cheng

(57) ABSTRACT

A firearm training system includes a training firearm, which includes a laser transmitter module that emits a laser signal along a longitudinal centerline of the barrel of the firearm in response to a mechanical wave generated from pulling the trigger of the firearm. A laser-detecting target includes a planar array of laser light detectors capable of detecting the exact location that the laser signal hits the target. The laser signal transmitted by the training firearm is preferably a modulated laser pulse that the target can easily discriminate from noise and interference. The target is connected to a computer, which reports laser hit information and keeps track of a sequence of laser hits fired by a competitor or trainee. Computer can be linked via a communications network to similar firearm training systems to enable competition between shooters at different geographic locations.

79 Claims, 6 Drawing Sheets

U.S. PATENT DOCUMENTS

| | | | | |
|---|---|---|---|---|
| 4,811,955 | | 3/1989 | De Bernardini . | |
| 4,830,617 | | 5/1989 | Hancox et al. . | |
| 4,948,371 | * | 8/1990 | Hall | 434/21 |
| 5,095,433 | | 3/1992 | Botarelli et al. . | |
| 5,140,893 | | 8/1992 | Leiter . | |
| 5,328,190 | | 7/1994 | Dart et al. . | |
| 5,344,320 | | 9/1994 | Inbar et al. . | |
| 5,433,134 | | 7/1995 | Leiter . | |
| 5,585,589 | | 12/1996 | Leiter . | |
| 5,605,461 | | 2/1997 | Seeton . | |
| 5,685,636 | * | 11/1997 | German | 362/259 |
| 5,716,216 | | 2/1998 | O'Loughlin et al. . | |
| 5,788,500 | * | 8/1998 | Gerber | 434/22 |
| 5,842,300 | * | 12/1998 | Cheshelski et al. | 42/116 |

* cited by examiner

NETWORK-LINKED LASER TARGET FIREARM TRAINING SYSTEM

CROSS REFERENCE TO RELATED APPLICATIONS

This application claims priority from U.S. Provisional Patent Application Ser. No. 60/056,937, entitled "Instrumented Target for Scaled Target Training", filed Aug. 25, 1997. The disclosure of that provisional patent application is incorporated herein by reference in its entirety.

BACKGROUND OF THE INVENTION

1. Field of the Invention

The present invention relates to a firearm training system employing laser-emitting firearms and laser-detecting targets, and, more particularly, to a training firearm having a laser module that emits laser pulses along a centerline of the barrel of the firearm toward a laser-detecting target which may be linked via a computer network to similar, remotely-located training systems.

2. Description of the Related Art

Shooting sports today include a variety of competitions including firing handguns, rifles and other firearms at bull's eyes and other types of targets. Measures of performance used to determine relative and absolute success include accuracy, speed, shot grouping, range and a host of combinations of these and other criteria. A combination of skills, competitive talents, and firearm performance is required to enable someone to compete successfully in the shooting sports. The skills involved include the integrated act of combining marksmanship fundamentals, such as proper firing position, trigger management, secure grip and correct sight picture. Competitive talents associated with the various shooting sports include being able to shoot accurately on the move, being able to draw a handgun from a holster, and being able to control breathing and movement so as to create a very stable platform for achieving pinpoint accuracy on a target.

The history of shooting as a sport reaches as far back as the invention of the first firearms. In excess of 10 million Americans regularly participate in one of the forms of officially recognized shooting sports. Varieties of shooting sports are part of both the summer and winter Olympics. Shooting is an internationally recognized competitive endeavor with its own championships, sponsors, competitive programs and sanctioning agencies. It is also a vibrant and dynamic sport, with new events and competitive options emerging frequently, e.g., cowboy action shooting.

Unfortunately, shooting sports suffer from a number of limitations and constraints that threaten the present and future vitality of the pastime. Foremost among these limitations are those associated with the shooting process itself. When a firearm is fired, some form of projectile is ejected from the firearm toward the target. This projectile (e.g., a bullet, musket ball, shot, BB or pellet) has the capability to injure or kill. The fact that the sport of shooting currently requires impact of a projectile with a target introduces a safety problem that limits the sport both physically and from an image point of view, contributing to the controversy now surrounding the private ownership of firearms.

It is undeniable that the tragedies associated with firearms, as well as the criminal acts committed with firearms, have harmed the image of the sport. In countries such as the United Kingdom and Australia, firearm-related tragedies have led to the banning of all private ownership.

No distinction is made regarding firearms reserved for sporting purposes. In many countries, such as Japan, ownership of private firearms has been illegal for some time.

The projectile fired by the firearm puts further constraints on the sport of shooting. Safety dictates that proper barriers and cleared areas be in place to prevent bystanders from being hit by direct fire and ricochets. This limits the ability of spectators to view competition. Special ranges are needed in order to conduct shooting sports anywhere within populated areas. These ranges are expensive to construct in accordance with zoning restrictions and expensive to insure. Moreover, competitions must be conducted at a common range (i.e., not at multiple, remote ranges) to ensure fair competition and to prevent the possibility of cheating.

Because spectators are restricted to watching shooting sport events from a safe distance behind the competitors, it is very difficult for the audience to see how the competition is progressing at any given time. In many circumstances, all of the firing must cease before targets can be inspected and scored. The audience must wait for this process to learn how their champion or team has fared. These constraints limit the audience of the sport, reducing its attractiveness in this age of computerized interactivity and immediacy to the participants themselves.

Equally problematic is the projectile, and specifically the lead bullet fired by most firearms. Lead is toxic, and the lead residue, including dust and other fragments, contaminate ranges of both the indoor and outdoor variety. Environmental protection laws are very strict in this regard, forcing range operators both to install expensive air cleaning and handling systems and to remediate existing range facilities.

Thus, while the sport of shooting is popular, enjoys a long heritage, and does meet all of the criteria for both individual and team competition, the very nature of the process of shooting is itself limiting. The unfortunate linkage to criminal and tragic acts further limits the potential of the sport and, in many cases, has directly led to its restriction.

Further, there is an ongoing need to train law enforcement officers and soldiers in the use of firearms, but using live ammunition at realistic ranges requires space and material which can be difficult to provide. The normal course of instruction (COI) relies on the use of live ammunition, and is called "live fire training." Live fire training is dangerous, requiring properly surveyed and sized ranges, barriers and impact areas, and the use of lead bullets in live fire training is a pollution hazard, with associated remediation expenses. The U.S. government presently is spending considerable sums to clean up lead pollution at live fire ranges across the country, and an alternative to live fire training would be desirable from a remediation cost savings point of view alone.

Marksmanship training is intended to build and refine individual skills. However, in the case of most military units, conducting live fire training is done collectively, in that all of the members of the unit go to the firing range together. Primarily, this is due to the fact that live ammunition is carefully controlled. Also, since live fire ranges are scarce resources, their use must be scheduled. This entails significant advance coordination and planning, especially for reserve component units such as the Army and Marine Reserves of the Air and Army National Guard. These units meet monthly, on weekends typically, at centers of armories without suitable range facilities. Units must be transported to and from suitable training ranges, which often are a significant distance away, and supported with food and shelter while at the range. Those experienced in such matters will recognize that the ability to conduct suitable firearms training in the centers and armories ("at home station"), on an individual basis when needed, could provide significant savings and increase training value.

For the training to be meaningful, a formal COI is imposed, such as that noted for the M16A1 and M16A2 rifle in U.S. Army field manual FM 23-9, and a test is required. This test assesses the trainee's ability to meet the standards set forth in the COI, and is typically referred to as "qualification". Passing the test means the trainee meets the standards and is qualified to use the weapon.

The qualification test includes a requirement to engage and hit standard targets of different sizes and having different shapes disposed at various ranges from the trainee. The actual distance to a target is called the range. Typically, rifle marksmanship skills are tested out to ranges of 300 meters for modern military rifles, and 25 to 50 meters for handguns. The longer ranges obviously impose significant acreage requirements for live fire range facilities. Consequently, the armed forces have formulated scaled target alternate courses which use silhouette targets sized to simulate different range-to-target distances based on fundamental mathematical formulas, thereby allowing the soldier to practice sight alignment skills on a sight picture of the appropriate size for a simulated target at a given range.

These scaled target alternatives to actual distance ranges still require the use of live ammunition in a live fire range, with all the associated safety, pollution, and resource consumption implications noted above. Thus, while the use of scaled targets reduces the "real estate" required at the live fire range, it does not eliminate the need for, and associated costs and penalties of using a live fire range.

Both the Air Force and Navy have equivalent scaled target qualification procedures. These scaled qualification targets are accepted alternatives for testing the marksmanship skills of units that do not have access to full scale ranges, or are otherwise authorized to use scaled targets, and are therefore known as "Alternative Course" targets. For example, the Army uses the target shown in FIG. 1 which is called the "25 Meter Alternate C Course Target". The 25 meter descriptor denotes the range to which all of the targets have been scaled, and is the distance at which the target is to be engaged by the trainee.

Ideally, the alternate course exercise is conducted with a weapon which looks, feels and operates in a manner as close as possible to an actual service rifle (or pistol). Preferably, the simulated audible report shooting experience includes an audible report and recoil.

These scaled targets suffer from many of the same problems associated with all live fire training. In particular, a bullet strike on the target cannot be differentiated from another strike on the same target without some elaborate detection means at the firing line, a location hit detection means at the target itself, or an individual target inspection after each round fired. In all cases, the costs associated with such discrimination means are significant, with the result that they are rarely used. Training assessment accuracy suffers as a result.

For example, in the Army 25 Meter Alternate C Course of fire, the soldier is required to fire in two sessions to qualify. The first session requires that the soldier fire 20 rounds, held in two 10 round magazines, from a prone position with the weapon supported on a sandbag. The soldier has 120 seconds to hit each of the 10 scaled target silhouettes on the target (FIG. 1) two times. Having the weapon supported on the sandbag provides added stability to the weapon and enhances accuracy.

The second session requires that the soldier fire a second string of 20 rounds from a prone position with the weapon unsupported. Unsupported means that the soldier can use only his arms, with elbows resting on the ground, to hold the weapon steady. The relative stability and accuracy of the unsupported firing position is reduced relative to that of the supported firing position.

Typically, since the paper targets are cheap and save time, the two 25 meter targets required for the qualification test are mounted side-by-side on a suitable backing in full view of the trainee. The soldier is instructed to fire on one of the targets first, and, after the 120 second period elapses and all 20 rounds are accounted for, then the second target. However, since the targets are the same, and since the smaller (greater scaled range) targets are harder to hit, soldiers frequently engage all the small silhouettes on both targets during the supported session. The larger silhouettes (the 50 meter and 100 meter ranges) are left for the unsupported session.

More generally, since the shooting range is "hot" during the entire shooting exercise, it is not possible to closely inspect the target and determine the order in which a shooter has engaged each target and it is also not possible to determine whether a shooter was aiming for a target at the time an impact was observed on that target (i.e. that silhouette). Consequently, it is possible for an unskilled shooter to shoot the targets in random order and still obtain a qualifying score, since the silhouettes are clustered onto a single sheet for alternate course qualification exercises.

Since the scoring takes place after both firing sessions are complete (again to save time, since scoring the targets requires that everyone cease fire so that the instructors can go downrange and physically inspect the target), inaccurate assessments of the soldiers' marksmanship skills may result. It should come as no surprise that significantly lower test results are frequently achieved when the soldiers are retested on the actual distance ranges where the targets are presented randomly across the field of view.

Thus, it can be seen that to take advantage of the scaled silhouette target concept, it is preferable for the target to be able to distinguish the location of each hit and the time sequence of the hits, and to communicate that information to the scorer/instructor in real time. Preferably, the target would include a method for determining if the trainee is at the correct range so that training and testing could be accomplished autonomously.

To take full advantage of the scaled target concept, while simultaneously avoiding the safety, pollution and other negative issues associated with live fire, there is a need for a weapon simulator that looks, feels and operates as the actual weapon but does not fire a live round, and provides the full psycho-kinetic experience to the trainee, including felt recoil, sound, and smell that the soldier would realize on the live fire range. The simulator would have an alternative and totally safe means for accurately hitting the target. Preferably, the simulator would be untethered so as not to restrict the trainee's movement, grip, or position while firing, and would also require the trainee to reload, charge and clear the simulator in the same manner as the actual weapon so that no part of the value of live fire training is lost. It is desirable that both the simulator and the target support qualification testing with the weapon's standard day sights as well as with the latest developments in night vision and thermal detection systems so that the unit is not required to use a live fire range at all.

Another drawback to live ammunition is its use in the process of "zeroing" a sighted firearm. The process of correctly adjusting the sight mechanism of a firearm typically involves two steps. First, the sight mechanism of the firearm is aligned with the centerline of the bore in a process known as "boresighting." Boresighting achieves a coarse alignment which generally allows the shooter to hit the target when the sight is trained thereon, though the hit locations are typically clustered at a point off center. This is because boresighting does not take into account the fact that each shooter has a unique "sight picture", meaning that each shooter aligns his or her eye with the sight slightly differently, as a function of his or her proper firing position, thereby seeing the location of the center of the target somewhat differently. Assuming the shooter can repeatably take up the proper firing position and fire a group of shots within a certain diameter on the target, a fine adjustment (i.e., zeroing) of the sight mechanism can be achieved by determining the offset between the center of mass of the hits in the shot group and the center of the target, and then adjusting the sight mechanism accordingly. By repeating this process a number of times, the offset between the center of the target and the center of mass of the shot group can be minimized, such that the firearm is "zeroed" for a particular shooter.

In order to determine the true offset accurately, it would be advantageous to have many shots in the shot group for each iteration of the zeroing process. However, numerous shots consume ammunition resources. Further, it is difficult to estimate (by eye) the center of mass of more than three hit points. For these reasons, no more than three shots are typically fired for each shot group, with the consequence that the accuracy of the estimate of the offset is limited, and more iterations of the zeroing process may be required (relative to iterations with larger shot groups). Consequently, it would be advantageous to be able to use larger shot groups in the zeroing process without the attendant difficulties in measuring the center of mass and without increased usage of resources, in order to reduce the number of iterations required to complete the zeroing process, thereby to save time.

Various systems for training a shooter without requiring the firing of live ammunition have been proposed, including systems incorporating optical and laser technology. The firing of blank cartridges from firearms give the shooter a sense of how the firearm will feel under live fire conditions. Blank firing conversions for semiautomatic pistols are the subject of U.S. Pat Nos. 5,140,893, 5,433,134 and 5,585,589(all to Edward J. Leiter), the entire disclosures of which are incorporated herein by reference. However, because such systems do not fire a projectile at a target, the shooter is not provided with any feedback as to whether the firearm was properly aimed on whether good follow through was maintained.

In addition, laser drivers have been used for transmitting a laser beam as a training aid in firearms, as disclosed in U.S. Pat. No. 5,344,320, the entire disclosure of which is incorporated herein by reference. In laser-based systems, a laser transmitter is typically mounted to one side of the firearm's muzzle, and projects a laser signal onto a target to simulate firing of a projectile and a hit location. One problem with such systems is that the laser signal is not projected along the longitudinal centerline of the barrel (as a projectile would be); thus, the projection angle of the laser must be slightly angled relative to the longitudinal centerline axis of the barrel so that the laser signal hits the target in the same location that a projection fired from the barrel would hit the target. This arrangement introduces a parallax problem, wherein the laser projection angle must be adjusted as a function of the target range in order for the location of the laser signal on the target to accurately reflect the location that a projectile would hit the target.

To eliminate the parallax problem, it has been proposed to mount a laser transmitter directly in the barrel of a firearm. In particular, Bang Corporation has developed a cylindrically-shaped laser module which slides into the muzzle of a pistol and is held in place by frictional force. When the firearm trigger is pulled, the laser module detects resonance of the fall of the hammer and emits a visible laser signal which can be seen on a paper target or the like. However, because the laser module rests within the barrel, the firearm cannot fire live ammunition or even a blank while the laser is in use, and the trainee feels only a "click" of the hammer upon pulling the trigger. Consequently, the in-barrel laser does not allow the trainee to experience any recoil or firing effects whatsoever, and provides a poor simulation of the psycho-kinetic experience associated with operating the firearm with live ammunition, with no audible report or recoil. Further, live ammunition can accidentally be loaded and fired while the laser is within the barrel, presenting a potential safety hazard to the trainee and others in the vicinity.

Moreover, many laser-emitting firearm training devices, including the Bang Corporation's in-barrel laser, simply project a laser signal on a paper target or the like without any detection of the laser signal, thereby requiring simultaneous visual inspection of the target, and making these devices unsuitable for the aforementioned military training exercises involving a sequence of firings.

SUMMARY OF THE INVENTION

It is an object of the present invention to solve the aforementioned problems while preserving as much of the essence of shooting sports as possible, so that the experience is not diminished and the attractiveness of the sport can actually be expanded.

It is another object of the present invention to provide a training firearm which closely simulates the experience of live firing, including an audible report and recoil of the firearm, without firing a projectile.

It is yet another object of the present invention to permit realistic firearm training without the space and expense associated with a live fire range and the environmental and safety hazards associated with use of live ammunition.

It is a further object of the present invention to improve the ability of spectators or trainers to view shooting competitions or training exercises.

It is yet a further object of the present invention to enable automatic scoring of each target hit, including a determination of the order of target hits.

Another object of the present invention is to more accurately assess a trainee's marksmanship skills on standardized targets.

Yet another object of the present invention is to make competition and training more practical by eliminating the need for a live fire range and by allowing competition or coordination of exercises between shooters at different locations.

A further object of the present invention is to ensure fair competition and prevent cheating among people competing from multiple locations.

Yet a further object of the present invention is to improve the process of zeroing the sight mechanism of a firearm by automatically determining a center of mass of shots groups, which may be of any size, without use of live ammunition.

The aforesaid objects are achieved individually and in combination, and it is not intended that the present invention be construed as requiring two or more of the objects to be combined unless expressly required by the claims attached hereto.

According to the present invention, a laser pulse is substituted for the projectile of conventional firearms. Preferably, this laser is eye safe, as defined by appropriate ANSI and U.S. Food and Drug Agency standards. This one change lifts immediately the major constraints facing the sport of shooting, in that both the safety and the pollution issues raised by the use of lead bullets are answered. Preferably, the laser transmitter fits directly into the barrel of the firearm and emits a laser pulse along the longitudinal centerline of the barrel to avoid any range-dependent parallax problems.

In accordance with one embodiment of the present invention, the training firearm is formed by replacing the conventional barrel of a firearm with a training barrel which preserves the look, feel and firing action of the conventional firearm. Specifically, the bore of the training barrel is completely blocked by a solid wall extending transversely through the barrel and separating the bore of the barrel into a proximal firing chamber sized to chamber only a blank cartridge adapted for use with the training barrel, and a distal cavity which houses a laser transmitter module. The laser transmitter module can be permanently mounted with the cavity or can be a cylindrically-shaped removable module which is threadably or slidably insertable into the muzzle of the barrel. The laser transmitter module includes a mechanical wave sensor which senses a mechanical wave from the discharge of the blank cartridge and triggers the laser transmitter to emit a laser signal. The laser transmitter module does not protrude significantly from the muzzle and therefore does not affect the holstering of the firearm. The training firearm used in conjunction with the firearm training system of the present invention can also take the form of a firearm specifically designed to fire only laser signals or a conventional firearm fitted with a removable laser transmitter module which is inserted into the muzzle of the barrel.

The firearm training system of the present invention further includes a laser-detecting target having a planar array of laser light detectors which detect the location and timing of laser pulses received at the target. Preferably, the laser pulses are modulated with a particular modulation signal, and the laser light detectors are configured to detect the modulated laser pulses in order to mitigate the effects of interference. The laser light detectors can be arranged in any manner to simulate any type of competitive or training target. In particular, the laser light detectors can be arranged to simulate a military scaled target, such as the 25 Meter Alternate C Course Target.

The laser-detecting target is connected to a computer which analyzes target hit information, keeps track of hits information and statistics, and displays feedback or scoring information. The target and computer provide real time feedback on the location of each laser shot thus allowing a referee, trainer, or spectators to see how the shooter is performing during the shooting exercise. Further, more accurate assessment of marksmanship skills is made possible, because the order and timing of shots is recorded, and credit is given only for hitting an intended or specified target on a particular shot.

The computer can be connected via a communications network, such as the Internet, to similar systems, so that competitions or training exercises can be conducted across multiple geographic locations. Such competitions or exercises can be controlled from a central system or unit which may be accessible to individual shooters via an Internet web site.

To permit unsupervised competition, the present invention includes means for preventing cheating among competitors at different locations. Specifically, an ultrasonic transmitter is incorporated into the training firearm and emits an ultrasonic signal at the same instant as the laser pulse is transmitted by the laser transmitter. An ultrasonic detector detects the arrival of the ultrasonic signal at the target, and the target determines a time delay between the laser pulse and the ultrasonic signal. This time delay is used to calculate the distance between the training firearm and the target, which distance is reported to a referee or to other competitors, and prevents a competitor from cheating by standing closer to the target than the specified range.

The firearm training system of the present invention also allows closed-loop zeroing of a sighted firearm. Specifically, the system automatically calculates the center of gravity (relative to a center of the target) of a group of three or more shots to enable accurate assessment of the required realignment of the sights. Because the system permits shot groups containing more than the conventional three shots, a more accurate offset can be determined with each iteration of the zeroing process, thereby reducing the number of required iterations.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENTS

The firearm training system of the present invention includes a training firearm which emits a laser pulse when fired under conditions closely simulating the firing of a projectile, a target adapted to detect laser pulses, and a computer system which determines and stores information relating to laser pulse detections, which system may be linked via a network to similar, remotely-located training systems.

Figure 2:
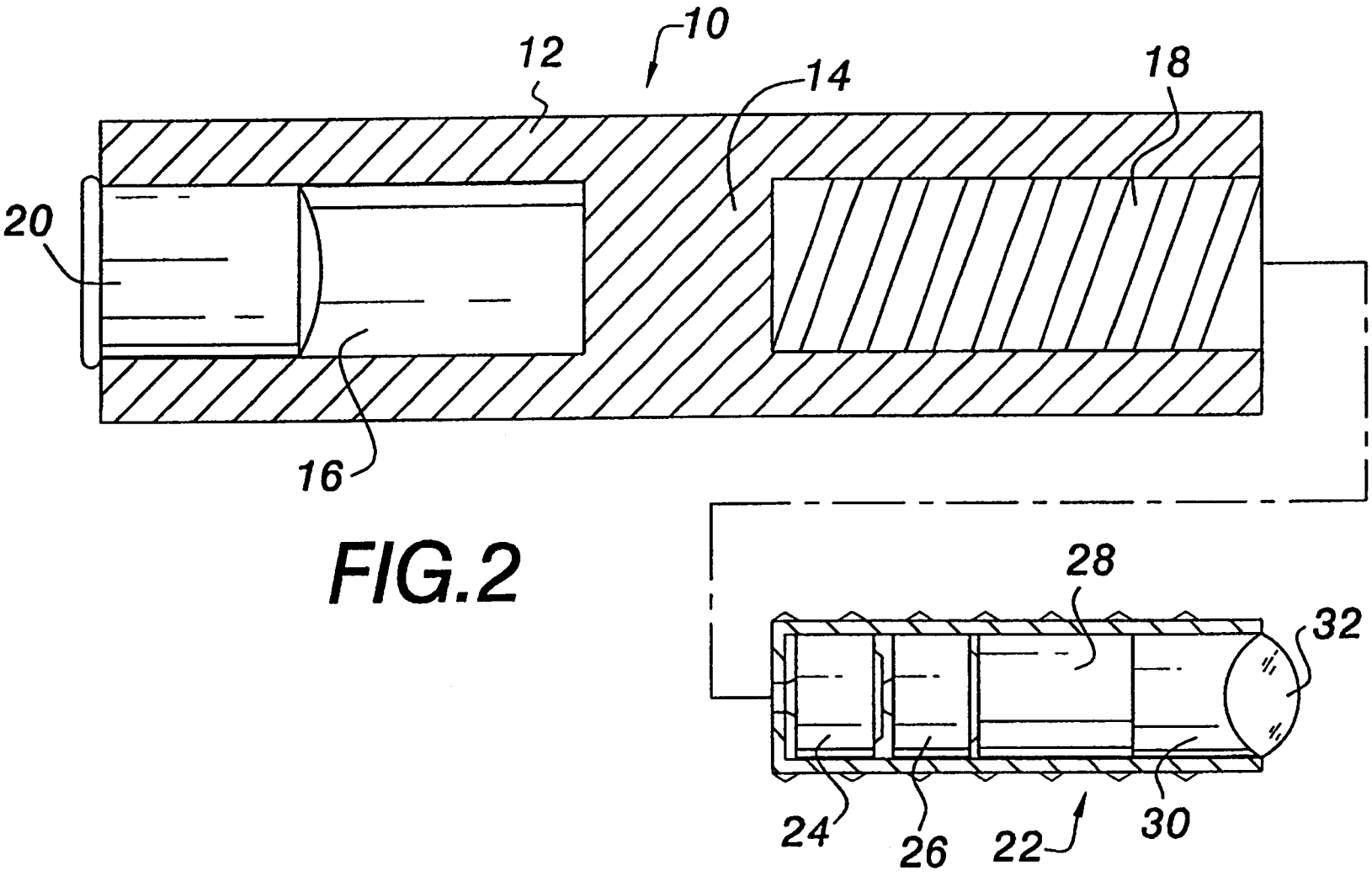
FIG. 2 is a sectional view of a firearm training barrel in accordance with an exemplary embodiment of the present invention.

FIG. 2 illustrates an exemplary embodiment of a training barrel 10 for a training firearm in accordance with one aspect of the firearm training system of the present invention. Training barrel 10 can be a drop-in replacement barrel for a pistol having a removable barrel. Similarly, the training barrel of the present invention, together with an upper receiver, can serve as a drop-in replacement barrel and upper receiver for a rifle.

As illustrated in partial cross-section in the diagram of FIG. 2, a drop-in replacement barrel 10 for a pistol (or rifle) includes a barrel-shaped (i.e., having the shape of a typical firearm barrel) main body 12 defining a substantially cylindrical bore along a longitudinal centerline of main body 12 with openings at the proximal and distal ends. Body 12 is made from stainless steel or another conventional material. The bore of barrel 10 is completely blocked by a solid steel section or wall 14 extending transversely through main body 12 and separating the bore of the barrel into a first substantially cylindrical cavity 16 extending from the proximal end to wall 14 and a second substantially cylindrical cavity 18 extending from the distal end to wall 14.

The first cavity 16 extending inward from the proximal end of the barrel 10 serves as a firing chamber and is sized to accommodate a specially adapted blank cartridge 20. By correctly sizing the powder charge in the blank cartridge 20 at approximately ¼ the normal powder charge, there is no adverse affect upon the weapon's original live-fire performance and so basic weapon familiarization and training are readily accomplished. Since the bore of the training barrel is occluded, there is no forward discharge whatsoever from the muzzle (i.e., the distal end), and the firearm may be fired at point blank range without creating a hazardous condition. The chamber formed by cavity 16 of barrel 10 is sufficiently short so as not to allow a live round to be chambered, and the head space of cavity 16 is sized so as not to allow a normal blank round to be chambered. In the preferred embodiment, training barrel 10 has a residual discharge only from the ejection port of the weapon. Preferably, barrels are color coded at the ejection port and the muzzle for immediate identification as blank fire units and are marked with the appropriate model and caliber designation as well as with the proper training blank loading. That color coding is matched by color coding on the specially adapted blank ammunition in order to prevent a dangerous mismatch of ammunition to the training barrel. Preferably, blank cartridge 20 is all brass, includes no wad, and uses non-corrosive primer and powder materials.

The second cavity 18 extending inward from the distal end of the barrel 10 is adapted to hold a laser transmitter module 22. In accordance with an exemplary embodiment of the present invention, the laser transmitter module 22 is a cylindrically-shaped removable module having a threaded outer surface. As shown in FIG. 2, the interior surface of body 12 forming the wall of cavity 18 is threaded to receive the outer threaded surface of cylindrical module 22, such that module 22 can be threadably inserted or screwed into cavity 18. Alternatively, the laser transmitter module can slide into cavity 18 and can be held in place by frictional force or longitudinal grooves.

Laser transmitter module 22 includes a power source comprising first and second button batteries 24 and 26, a mechanical wave sensor 28 and an optics package 30 for projecting a laser beam distally through lens 32 toward a target. The laser beam is triggered in response to a mechanical wave sensed from the discharge of a blank. As used herein, the term "mechanical wave" or "shock wave" means an impulse traveling through the barrel structure. When the trigger of the firearm is pulled, the blank cartridge is fired (explodes), and creates a mechanical wave which travels distally down the training barrel toward laser transmitter module 22. Mechanical wave sensor 28, which may include a piezoelectric element, an accelerometer or a solid state sensor such as a strain gauge, senses the mechanical wave from the discharge of blank cartridge 20 and generates a trigger signal. Optics package 30 responds to the trigger signal generated by mechanical wave sensor 28 by generating and projecting a laser beam toward the target. The shock wave travels faster in the barrel than a fired bullet would travel; however, the delay associated with the shock wave reaching mechanical wave sensor 28 and the time required to activate optics package 30 and illuminate the target is approximately equal to the bullet travel time in a live fire exercise.

Preferably, optics package 30 includes a class I laser (of either 630 or 670 nanometer wavelength) and is ruggedized to maintain the aim point over many simulated rounds of fire. Optics package 30 and/or lens 32 can be adjusted to eliminate any azimuth or elevation angular offset between the direction that the laser pulses are projected and the longitudinal centerline of the bore of the barrel. For example, the laser transmitter module 22 with optics package 30 can be threadably inserted into the bore from the muzzle, as shown in FIG. 2, and then can be adjusted for azimuth and elevation at the factory or by the user.

The laser signal emitted by the laser transmitter module of the present invention is a laser pulse. To account for the effect of recoil on barrel orientation, the pulse width of the transmitted pulse is set to approximately ten milliseconds thus allowing the system to measure an individual shooter's ability to "follow through" after the shot. For large ranges from the target, the effect of recoil and poor follow through can cause a target to be missed.

The laser signal is preferably modulated. By way of non-limiting example, a 40 kilohertz amplitude modulation can be applied to the laser pulse. The signal processing circuitry used in conjunction with the target of the present invention (described hereinbelow) is adjusted to detect a laser signal modulated with a 40 kilohertz signal and is thereby provided with further protection against false hits which may be caused by spurious emissions of light in the presence of the detectors on the target.

It should be noted that the present invention is not limited to removable laser transmitter modules; the laser transmitter module can be permanently attached and mounted within cavity 18 or fully integrated with body 12, with an opening to replace the battery power source and, optionally, controls to adjust the laser transmission direction.

An important aspect of the present invention is that the transmitter laser module does not alter the holstering of the firearm (in the case where the firearm is a holstered weapon, e.g., a semi-automatic pistol). The laser transmitter module 22 barely protrudes from the distal end of body 12 when threadably or slidably inserted into the muzzle of barrel 10. This is an important consideration, since many law enforcement officers are required to enter a potentially dangerous crime scene with the gun holstered, thereby demonstrating no prior intent to shoot, and training exercises which would employ the training barrel of the present invention would therefore involve holstering. Preferably, the laser module protrudes from the distal end of body 12 (i.e., the muzzle) by less than 1 cm and more preferably no more than a few millimeters. Where the laser transmitter module is permanently mounted within the bore of the training barrel, the laser transmitter module need not protrude at all from the muzzle.

As will be understood from the foregoing, the training barrel of the present invention permits the firing of a blank cartridge in conjunction with emission of a laser pulse along the centerline of the bore of the barrel in order to create a realistic simulation of a live fire conditions, including the felt recoil and the firing sound. Since live ammunition cannot be chambered in the training barrel and no material can be discharged through the muzzle, the training barrel presents no safety hazard.

The training barrel 10 permits blank fire without discharge from the muzzle at the barrel distal end and permits repetitive fire with reliable cycling of a gas-operated (compressed air or $CO_2$) semi-automatic weapon. Preferably, the training barrel requires no permanent alteration of a service rifle or semi-automatic pistol and requires no replacement of any parts (other than the barrel or upper receiver) such as the recoil spring or magazine. With the blank fire training barrels of the present invention, a soldier can install or remove the drop-in barrel by field stripping methods and can then alter the service weapon into a training weapon having the original appearance and holstering capability (for pistols) of the service weapon.

Although the training barrel described above replaces a convention barrel of a firearm to convert a conventional firearm into a training firearm, the training barrel of the present invention need not replace another barrel or even be removable. In accordance with another embodiment of the present invention, the aforementioned training barrel can be part of a training firearm designed specifically for use as a training firearm.

Figure 3:
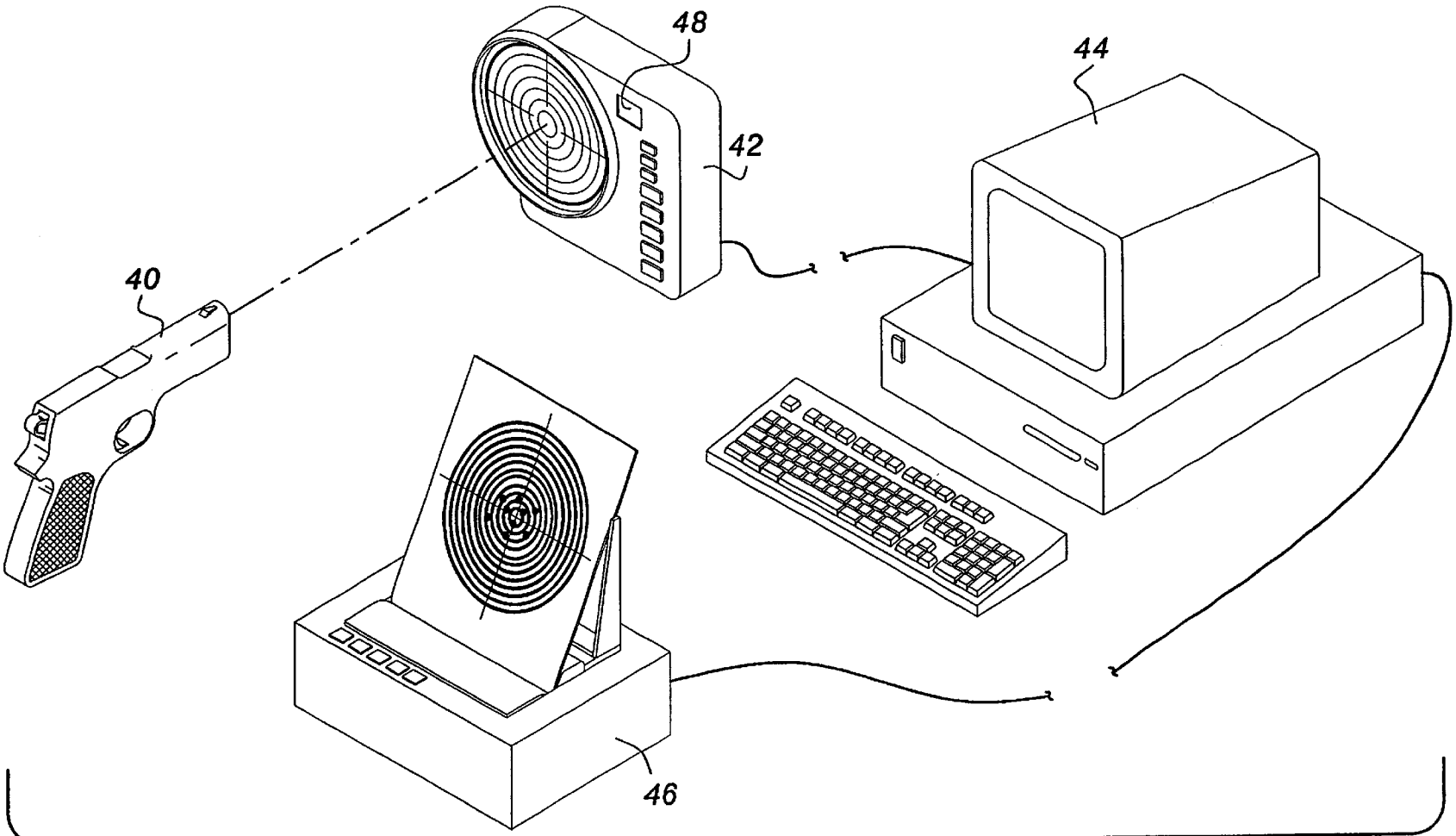
FIG. 3 is a diagram of an exemplary embodiment of the firearm training system of the present invention.

The firearm training system of the present invention includes a laser-emitting training firearm, such as that described above, as well as a laser-detecting target and a computer system which processes detection information. An exemplary embodiment of the firearm training system of the present invention, including a training firearm 40, a laser detecting target 42, a computer 44, and a printer 46 (optional), is shown in FIG. 3.

Training firearm 40 can take the form of a conventional firearm fitted with the above-described replacement training barrel. Alternatively, training firearm 40 can be a conventional firearm having a cylindrical laser transmitter module inserted into the muzzle of the barrel. In this embodiment, firearm 40 is not loaded with live ammunition or a blank when using the laser transmitter. The laser transmitter is activated by the fall of the hammer or the striker, sending a mild shock wave down the barrel of the firearm and activating the laser transmitter. Preferably, the transmitter is very lightweight, so as not to alter the perceived balance and feel of the firearm.

In accordance with another embodiment, training firearm 40 can be a laser-emitting firearm that is incapable of firing a projectile and that is designed for use only in training. Training firearm 40 cannot resemble actual firearms, to meet the aesthetic, competitive, commercial or functional needs of the user. According to this embodiment, the laser optics can be permanently integrated into the barrel of the firearm. Because the firearm is not able to fire a live round under any circumstance, it does not require licensing and control by the appropriate authorities such as the Bureau of Alcohol, Tobacco and Firearms (BATF) in the U.S.

Importantly, whether the training firearm is a training-only device, a conventional firearm with a laser module inserted in the barrel, or a conventional firearm fitted with a training barrel, the laser transmitter of the training firearm 40 of the present invention is preferably concentric to the bore of the barrel. This eliminates the problem of parallax associated with laser aiming and boresighting devices that are appended outside and alongside the barrel. The accuracy of such externally mounted lasers is highly range sensitive and requires constant realignment, making proper operation of such lasers difficult to understand and inconvenient to use.

Target 42 is responsive to the laser pulses emitted by training firearm 40 and provides appropriate feedback to the shooter via computer 44 or printer 46. As shown in FIG. 3, by way of non-limiting example, target 42 may take the form of a circular bull's eye, with a visible surface having circular lines drawn at regular radial intervals and horizontal and vertical lines which divide the target into quadrants. A plurality of laser light detectors or sensors are arrayed across the surface of target to detect the arrival of laser pulses emitted from training firearm 40. The arrangement of the laser light detectors is such that the location of a laser hit anywhere on the face of the target can be determined from the laser detection signals generated by one or a combination of the laser light detectors in the array.

Preferably, the laser light detectors are not sensitive to light energy coming from other sources, including those found in a home or indoor environment and sunlight. In particular, external light sources such as fluorescent lighting systems, infrared security systems, and other electro-optical emissions are filtered out so that the laser light detectors do not report erroneous hits or become desensitized by electromagnetic interference. To prevent such interference from impacting laser pulse detection, the laser light detectors and associated signal processing circuitry are preferably adapted to discriminate laser pulses that are encoded or modulated in a particular manner by the laser transmitter of training firearm 40. For example, the laser pulses can be amplitude modulated with a 40 Hz signal in the manner described above, and the laser light detectors can include signal processing for isolating the modulated laser pulses from other signals and interference. Other modulation or pulse encoding schemes may be used, and the laser light detectors may employ any variety or combination of techniques for distinguishing an electromagnetic signal from noise and interference, including, but not limited to matched filtering and range/time gating.

Optionally, individual firearms can emit uniquely modulated or encoded laser pulses which are distinguishable to the laser light detectors, to allow the firearm training system to identify the individual source of each laser pulse detected. This feature is useful when more than one shooter may be simultaneously or sequentially engaging a target or a set of targets.

Each of the laser light detectors provides an electrical detection signal to a corresponding line driver, and the signal is transmitted over a shielded cable or a short-distance wireless link (e.g., radio frequency or infrared) to a portable (laptop) or desktop computer 44. Power can be supplied to target 42 via a cord from a conventional AC power source, or target 42 can be battery powered. Computer 44 runs software which analyzes the electrical detection signals and provides feedback information about laser detections to the shooter, scorer or trainer via a display and/or printer. More specifically, the computer processes the electrical detection signals and provides the X-Y coordinates of the hit in the plane of the target face, the time of the hit, and the validation that the laser pulse was from a suitable laser. Further, the computer can keep track of a sequence of shots, and determine information such as the time between hits, mathematical analysis of the grouping information from multiple hits on a target, and the possible cause of shooting errors based on the interpretation of the variance between the point of aim and the point of impact, and report scoring or qualifying information for a shooter engaging the target in a competition or training exercise.

It will be understood from the foregoing that signal processing of detected laser pulses and data processing of the electronic detection signals are performed by a combination of target 42 and computer 44 in order to provide feedback information to the shooter. However, the performance of the signal and data processing required to produce output information is not limited to any particular allocation between target 42 and computer 44. Thus, for example, target 42 can send relatively "raw" detection information to computer 44, with computer 44 performing significant signal processing. Conversely, target 44 can include onboard microprocessor and memory capabilities, such that the target simply reports the aforementioned feedback information to computer 4 for display, printing or transmission.

While the target shown in FIG. 3 is in the form of a single bull's eye, the shapes and sizes of the targets of the present invention are not limited and can be configured to meet all of the currently sanctioned shooting competition requirements. Furthermore, multiple targets at one range or location can be connected to a single computer for processing of laser hits of one or more shooters on the targets.

Figure 1:
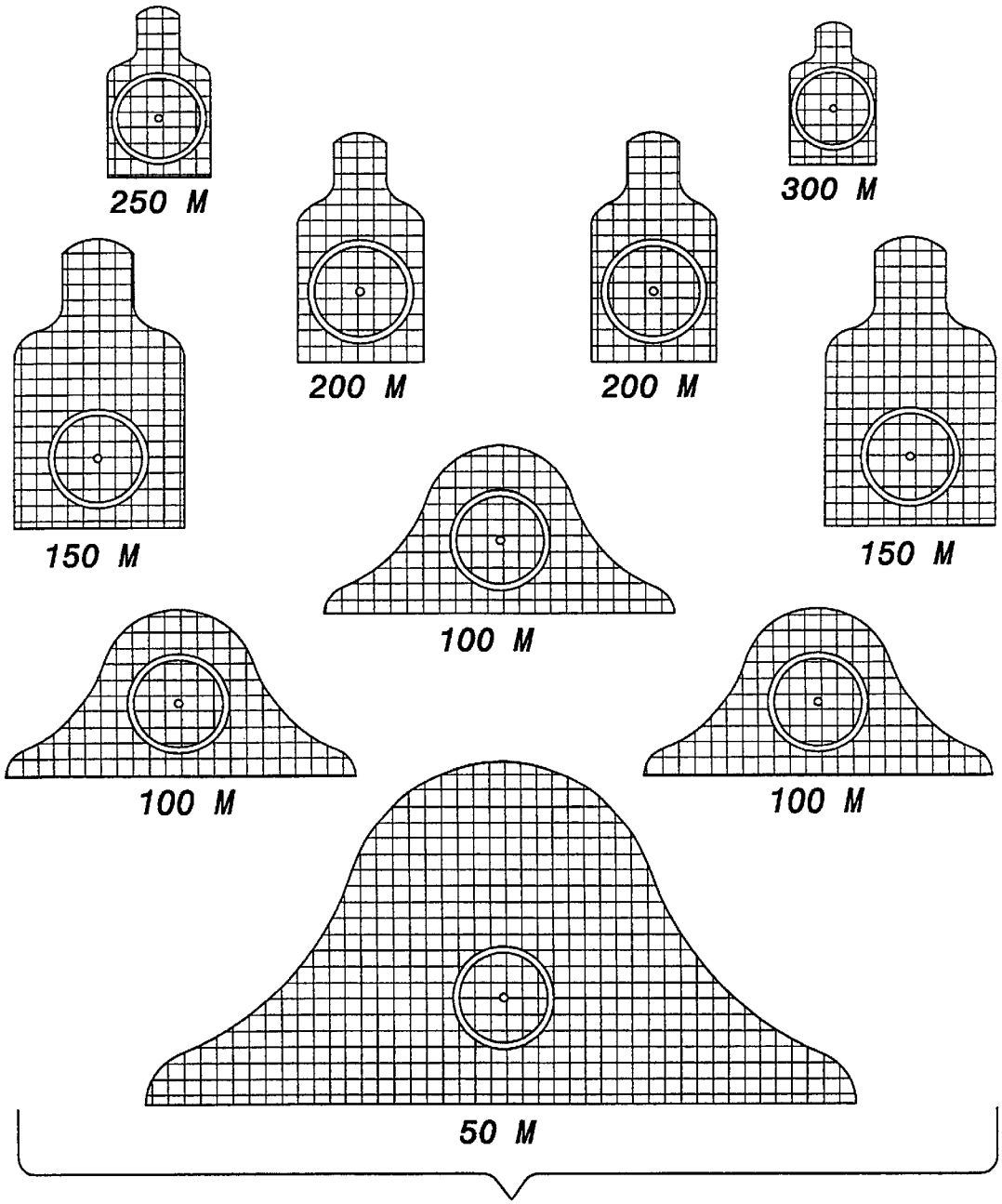
FIG. 1 is a representation of the U.S. Army's 25 Meter Alternate Course C Target.
Figure 4:
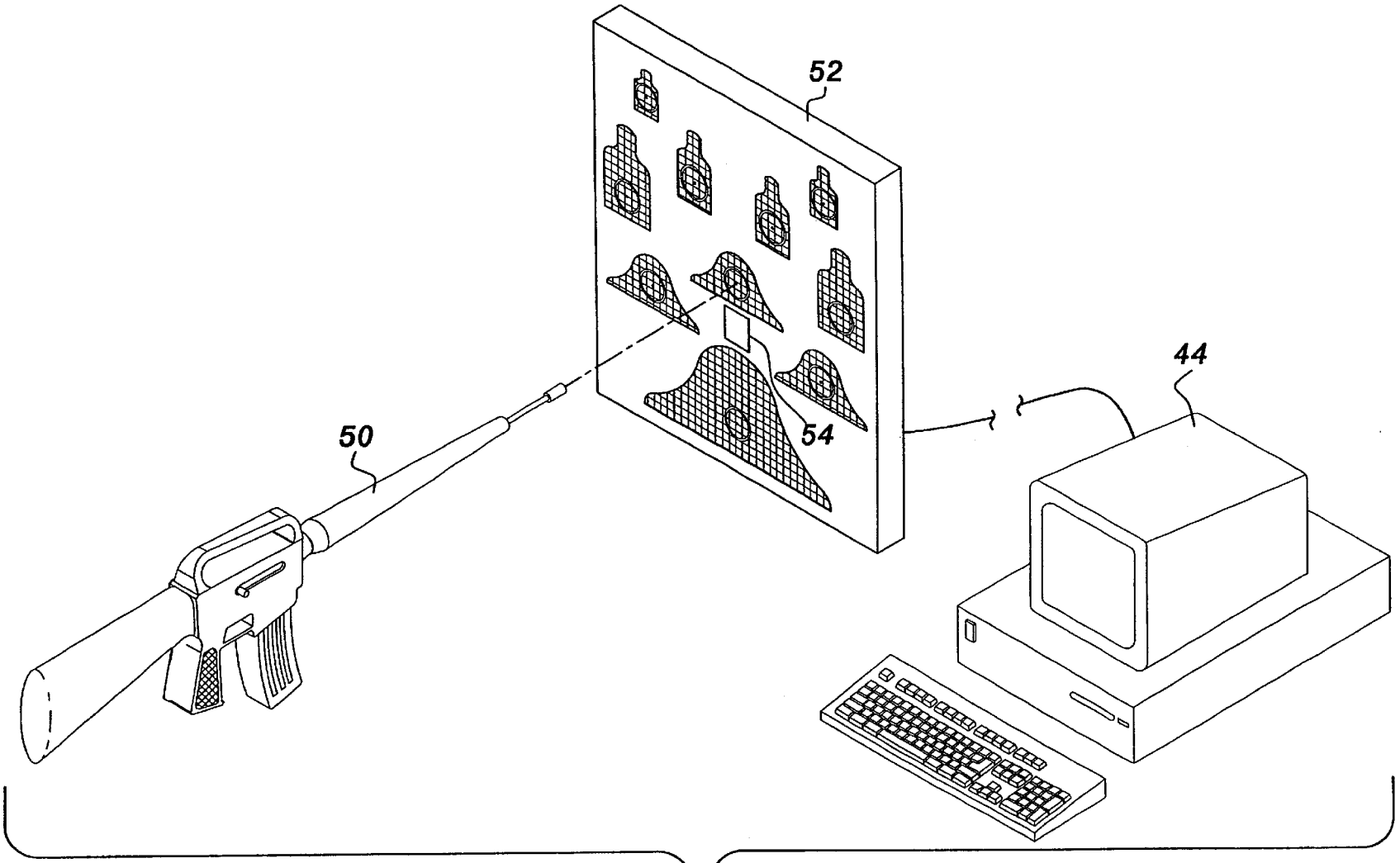
FIG. 4 is a diagram of an embodiment of the firearm training system of the present invention employing a laser-detecting target configured to replicate the U.S. ARMY'S 25 Meter Alternate Course C Target.

In accordance with a preferred embodiment of the present invention, the firearm training system of the present invention includes a set of targets adapted for use in military qualification exercises. As illustrated in FIG. 4, a plurality of laser light detectors or sensors is arrayed in a pattern to form a laser-detecting target 52 corresponding to the U.S. Army's 25 Meter Scale Target Alternate C Course qualification target (FIG. 1), where one detector is sized and positioned for the 300 meter silhouette, one detector is sized or positioned for the 250 meter silhouette, two detectors are sized and positioned for the 200 meter silhouettes, two detectors are sized and positioned for 150 meter silhouettes, three detectors are sized and positioned for 100 meter silhouettes, and one detector is sized and positioned for the 50 meter (largest) silhouette. Optionally, two or three detectors may be sized and positioned for the 50 meter silhouette. A training firearm 50, which is similar in size, shape and feel to the actual service firearm used with the live fire scaled target, emits laser pulses along the longitudinal centerline of the barrel toward the target in the manner described above.

Figure 5:
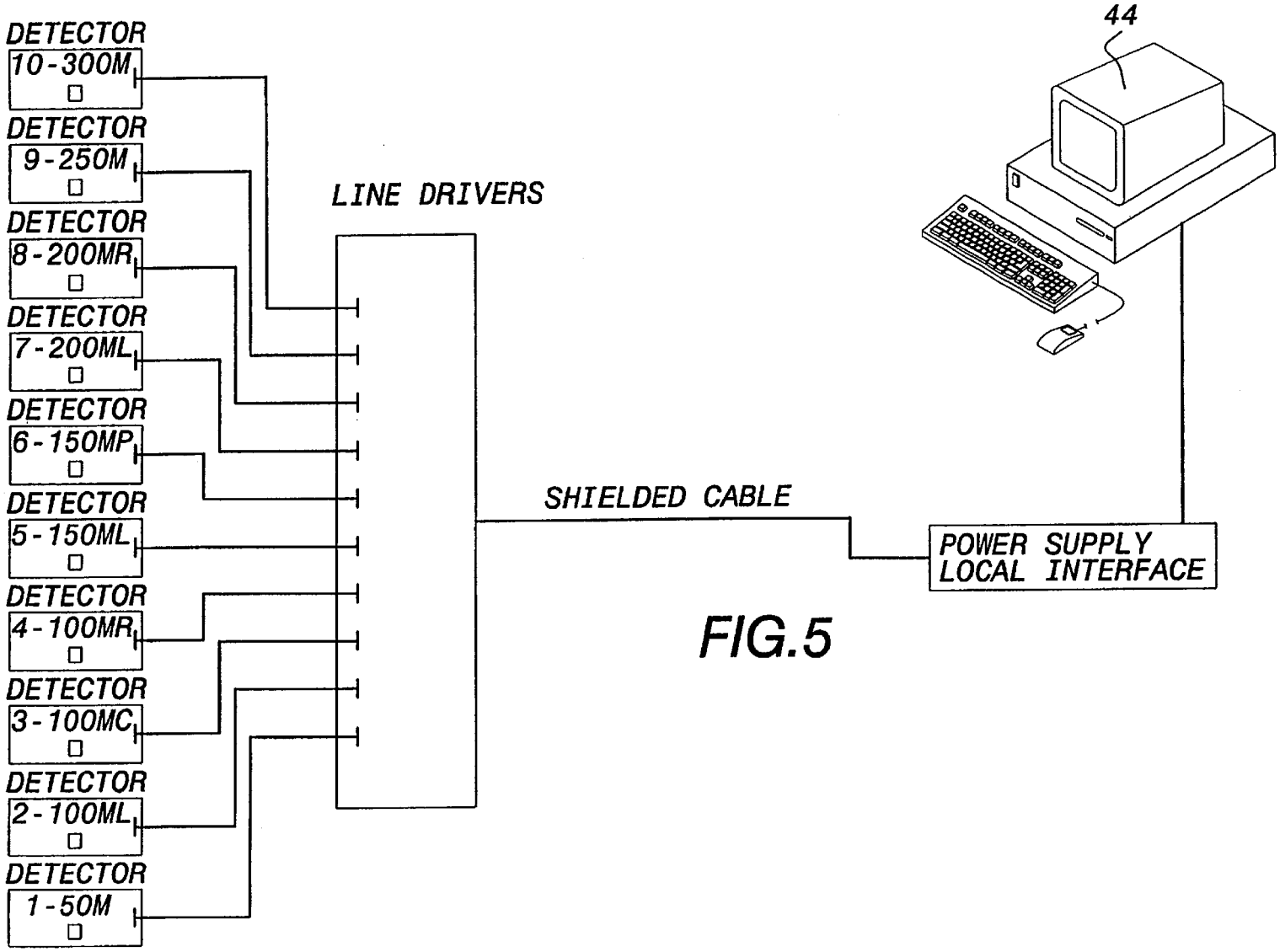
FIG. 5 illustrates the interconnection of the target shown in FIG. 4 with the computer of the firearm training system.

As shown in FIG. 5, each laser light detector of the scaled target provides an electrical detection signal to a corresponding line driver, and the signal is transmitted over a shielded cable to computer 44 via a power supply and local interface. Computer 44 is programmed with software adapted to score the sequence of laser hits in accordance with qualification requirements and produces a standard format scoring record (e.g., a printed form). The laser detection system advantageously allows each laser hit to be individually scored as it is fired by the shooter. In this case, the two 120 second segments of the exercise can be conducted while the range is hot and each shot can be scored, thereby avoiding the confusion associated with allowing the shooter to fire both ten round clips into the target before attempting to score the target, as discussed above. Unlike conventional scaled target qualification with live fire, because the timing and location of each shot is determined by the system, the trainee does not receive credit for hitting one target when attempting to hit another, and the trainee cannot "cheat" by firing at the long range targets primarily during the supported session and at the short range targets primarily during the unsupported session.

The laser-detecting targets of the firearm training system of the present invention can also be pop up or active targets at conventional ranges (e.g., three hundred meters or more). A wireless communication link is preferably used to transmit information from the active target of the present invention to a scoring computer for shot-by-shot reporting of the qualification exercise results. The information provided by the sensors detecting the laser pulse can also be used to activate a host of devices, such as flash bang generators, target turning and lifting mechanisms, and even animated or computerized results (e.g., explosions, bullet holes, etc.).

Computer 44 is capable of receiving, processing and displaying hit information in real time, such that a scorer, instructor or spectator may view the progress of a shooting competition or training exercise while in progress. For shooting competitions, the display can be provided at the shooter's location, for the immediate viewing audience, and simultaneously, at multiple locations worldwide. Optionally, the firearm system of the present invention includes a standard printer 46 (FIG. 3) for printing out shooting details including diagnosis of problems and suggested training solutions for correcting a shooter's technique.

In accordance with another aspect of the present invention, the firearm training system includes a linked network of laser-detecting targets and computers located at a single site or at multiple sites. Each target can be connected to a corresponding computer which is in turn linked to a central computer acting as a server. Alternatively, the server can receive the information from multiple targets and process each in turn through efficient software processing. The system includes the electronic linkage required to interconnect the target/computer network at one location with a similar network at one or more geographically separate locations. A candidate for such a link is the Internet, an operational, global, and readily accessible real time digital information exchange. Alternatively, a dedicated network using optical, wire and/or satellite communication links can be employed.

All of the information captured from the laser hit on target can be reduced to a digital format. Consequently, using the proposed invention, it is possible for a shooting sport competitor in one location to fire at a target and have the result, both in terms of location on target and the resulting score/effect, displayed immediately at multiple locations worldwide. The ability to electronically link multiple firing points, or competition sites, facilitates global shooting sports competitions without the associated costs of travel. Organizations such a shooting clubs, college teams, and commercially sponsored teams can compete against one another whenever they desired, regardless of time/distance constraints.

The cost of maintaining a suitable live fire range at or near the campus has caused many colleges to eliminate their shooting sports program. The present invention eliminates the need for such a range. In addition, the cost of traveling to other schools or competition sites, a significant expense and application of time, would be eliminated, would reinvigorate shooting sports at the college level.

More generally, in accordance with the present invention, a facility can have several computer/target "firing points". This enables teams to compete against each other without having to travel to distant locations. A number of computer/target "firing points" at one location can be linked into a local area network (LAN) and that LAN can in turn be linked to one or more LANs some distance away. The Internet or other network serves as a wide area network (WAN) for the purpose of multi-team competitions.

In accordance with another embodiment of the present invention, an Internet web site serves as a competition control unit. Potential competitors "log on" to the Internet using standard protocols and procedures, and access the electronic shooting sports web site in a conventional manner. The procedures for accessing a web site are well known and need not be described here. Once at the electronic shooting sports web site, the potential competitor identifies himself or herself to the site with pertinent information such as name, social security number, or some membership ID information. This enables the control unit to access the competitor's prior competition history and store information from the present session. The system automatically "shake hands" with the competitor's computer, and thereby with the target to ensure that the proper equipment is in place and operational.

In order to minimize the amount of data required to flow back and forth over the Internet (e.g., X-Y hit locations, hit timing, shot number, etc.), the event for competition can be selected from a menu of options available at the competitor's location, and control of the event at the competitor's site (e.g., presentation of pop-up or moving targets) can be controlled from the competitor's local computer rather than from commands sent from the competition control unit over the Internet. As the throughput capacity of modems and linked networks such as the Internet expands, the opportunity to send real time video scenarios, including moving targets (i.e., skeet, trap, pop up), and animated target reactions (fall down, explode, shoot back), from the web site to the competitor will expand.

In accordance with yet another embodiment of the present invention, the firearm training system of the present invention can present video/graphic target scenarios on a wall or screen via connection to one or more digital video projection systems. Examples of such projection systems include products by Sony, Proximal, and Panasonic. The impact point of the laser fired at such a projection can be determined with some accuracy by hit detection cameras properly calibrated to see the projected target area. The process by which such hit detection cameras operate is known. Such hit detection cameras see the laser hit on target generated by the transmitter described above.

Since these video projection systems tend to be expensive, it is most likely that the use of such moving target shooting sports events will be conducted at local competition sites. Since there is no hazard whatsoever in the process or equipment used to conduct electronic shooting sports, these competition sites may be established at convenient locations such as recreation centers, shopping malls, bowling alleys, and sports clubs. Traditional shooting ranges and clubs may also install them. Because the equipment is portable and easy to set up, competition sites may be set up as part of temporary events such as state fairs, special championships at sports halls and auditoriums, and the like.

The capability to coordinate competitive shooting events or training exercises simultaneously conducted at multiple sites introduces unique problems and issues. In particular, it becomes possible for a competitor or trainee at one site to gain an unfair advantage over other competitors by shortening the range to the target, supporting the training firearm in an unauthorized manner (e.g., fixing or mounting the firearm in a vice), or using a more accurate firearm than other competitors or trainees. The opportunity for cheating in such a manner is, of course, increased in circumstances where the competitor or trainee is not directly observed by officiating or supervisory personnel. To minimize the potential for cheating, the firearm training system of the present invention employs means that allow competitors at one location to be reasonably certain of the accuracy and fairness of the results achieved at any other location without requiring the presence of some neutral observer or referee at each competition site. The inclusion of such a cheating prevention methodology in the invention expands the scope of the potential use to individual homes, millions of which are already linked to the Internet.

In accordance with one technique for preventing cheating, an ultrasonic transmitter is incorporated in the training firearm of the present invention and transmits an ultrasonic acoustic signal at the instant the laser fires, thereby providing an acoustical signal traveling at a known speed (i.e., the speed of sound). The target includes an ultrasonic receiver adapted to detect the ultrasonic pulse transmitted from the training firearm. Since the laser pulse travels at the speed of light and the ultrasonic signal travels at the speed of sound, a measurable delay exists between the arrival time of the laser signal at the target and the arrival time of the ultrasonic signal at the target. An accurate estimate of the distance to between the firearm and the target can be calculated by multiplying the time delay between the laser and ultrasonic pulses by the speed of sound (this estimate ignores the travel time of the laser pulse to the target, which is less than 1 microsecond). This range calculation can be performed by the target receiver electronics or by the computer. This range calculation, which is reported via the network to a controlling unit, indicates whether the competitor is too close (or too far) from the target, thereby defeating any attempt at cheating in a competition or qualification exercise (by shooting from an easier and shorter distance from the target). This allows competition and qualification exercises to be conducted in a completely automated fashion, thereby avoiding requirements for additional personnel to observe and score the exercise in person. The ultrasonic anti-cheating feature is well suited to simultaneous head-to-head competition over communications networks, such as the Internet, in which competitors in different geographic locations can compete simultaneously and in large groups.

Figure 6:
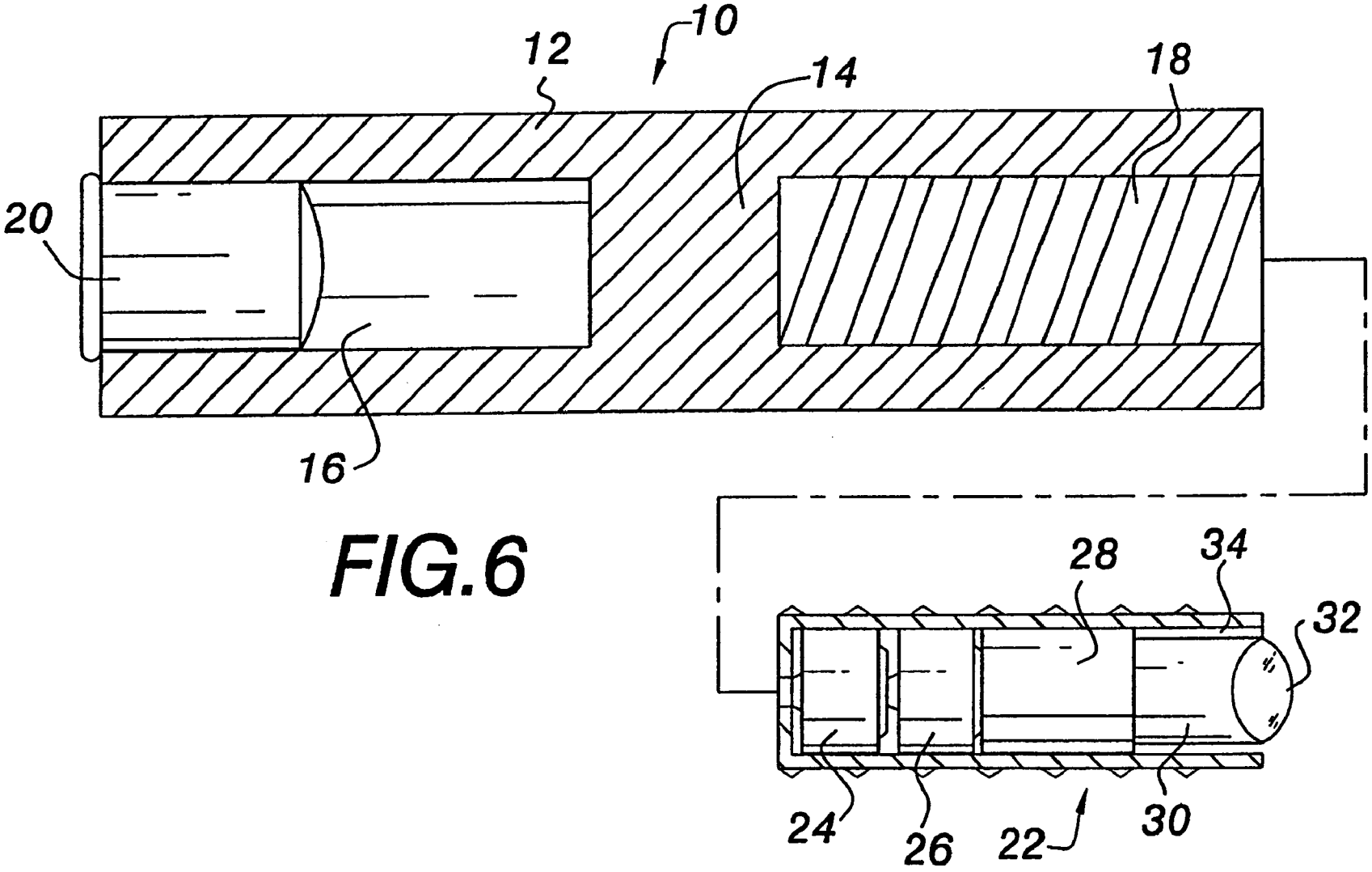
FIG. 6 illustrates another embodiment of the training barrel of the present invention in which an ultrasound transmitter is incorporated into the training barrel.

Referring to FIG. 6, the training barrel shown in FIG. 2 can be modified to incorporate an ultrasonic transmitter 34. Optics package 30 and lens 32, which are concentric with the longitudinal centerline of the barrel, are sized to permit ultrasonic transmitter 34 to be positioned along the periphery of the optics package within barrel 10. In response to detection of a fired blank, mechanical wave sensor 22 triggers both the laser transmitter and the laser emitting optics package 30 to respectively emit a laser and an ultrasonic pulse at the same time. Unlike a laser pulse, the ultrasonic wavefront widens with distance; thus, the ultrasonic pulse is detectable across the entire target. Consequently, while the ultrasonic transmitter is required to transmit ultrasonic pulses toward the target, it is not necessary for the ultrasonic transmitter to be concentrically arranged in the bore of the barrel or for the direction of the ultrasonic pulse to be precisely aligned. In fact, the ultrasonic transmitter need not be positioned within the barrel of the training firearm. Of course, the use of an ultrasonic transmitter is not limited to the training barrel embodiment of the invention, and can also be used with the aforementioned laser-only training firearm or a slide-in laser module in conjunction with the target of the present invention.

As shown in FIG. 3, an ultrasonic detector 34 can be located on the target adjacent the laser light detectors so as not to interfere with detection of the laser pulse. Similarly, an ultrasonic detector 48 can be positioned between targets on the 25 Meter Alternate C Course target shown in FIG. 4.

While the ultrasonic detector is preferably in the same plane and as close as possible to the laser light detectors, the precise location of the ultrasonic detector is not critical due to the relatively wide beamwidth of the ultrasonic pulse and due to the fact the ultrasonic pulse is used only to measure time/distance (and not X-Y position).

Another technique for preventing cheating in accordance with the present invention involves including encrypted information in the laser pulse to confirm to the target that the training firearm laser transmitter being "fired" is indeed authorized for the competition. Serial number registration, such as that in common use with electronic equipment, can be encoded in the laser pulse to help ensure that the competitor shooting is in fact the person registered for the event. Such registration information could be combined with novel developments in the field of fingerprint ID firearm trigger locks to further control surrogate competitors.

Further, the local computer or network system can include provisions for preventing cheating. For example, the computer can display instructions for each competitor to fire at a particular corner of the target in a random sequence determined by the computer or at secondary targets placed at the periphery of the primary target. Each competitor is required to aim and fire at the target in accordance with instructions unknown in advance. Since hitting the points in sequence requires some degree of rapid change in the point of aim, the competitor is precluded from locking the firearm down in a vice or rack to eliminate errors. Such an aim point check could be introduced at any time in the competition, and such a check can be implemented over a networked system.

In accordance with another aspect of the present invention, the network also includes the ability to recognize artificial results, such as an unnaturally accurate series of hits achieved by placing the training firearm in a vice or other mechanical support during the competition. Other measures for preventing cheating may be incorporated into the system, including, but not limited to, statistical sampling routines, records of a competitor's prior performance, and historical records of the best performance in a given event.

The firearm training system of the present invention is also useful for closed-loop zeroing of sighted firearms. The training firearm with the laser is mounted on a highaccuracy mandrel, is aimed at the target, and an initial estimation is made of a point of impact for a range of twenty-five meters or longer (i.e., the aforementioned "boresighting" process). The shooter then fires a group of simulated shots. Assuming the shot group meets the criteria for zeroing (e.g., the hit points fall with a 4 cm diameter circle), the computer determines the center of mass of the shot group of detected laser pulses and reports the center of mass information to the shooter (e.g., displayed on the computer screen or printed). The sights are then adjusted to compensate for the estimated offset between the aim point and the calculated center of mass. Next, another simulated shot group is fired and center of mass is again compared to the aim point in an iterative process which is repeated until the aim point is at the center of the target and within an acceptable offset, at which point the sights are deemed zeroed.

In accordance with the present invention, the use of laser pulses rather than projectiles in the zeroing process advantageously conserves resources. Moreover, because the center of mass calculation is performed by the computer, it is not necessary to limit the size of the shot group to three, as is required with live fire in order to accurately estimate the center of mass (and to conserve resources). Larger shot groups provide a better estimate of the offset of the sights than a three-shot group, which may reduce the number of zeroing iterations required to acceptably zero the firearm.

Having described preferred embodiments of a new laser-based firearm training system, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A detachable training barrel that replaces a conventional detachable barrel of a firearm to convert the firearm into a training device that emits a laser signal upon firing a blank cartridge, the training barrel comprising:

a barrel-shaped member defining a substantially cylindrical bore of the training barrel, with a proximal end and a distal end;

a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a removable laser module extending into said second cavity, said laser module emitting the laser signal in response to a mechanical wave sensed from the firing of the blank cartridge in said first cavity.

2. The training barrel of claim 1, wherein said removable laser module is substantially cylindrical and is concentric with said barrel-shaped member, such that said removable laser module emits the laser signal along a longitudinal centerline of the training barrel.

3. The training barrel of claim 1, wherein replacement of the conventional barrel with the training barrel, inclusive of said removable laser module, does not substantially affect holstering of the firearm.

4. The training barrel of claim 1, wherein said removable laser module lies substantially within said second cavity and protrudes from the distal end of said barrelshaped member by no more than 1 cm in a longitudinal direction.

5. The training barrel of claim 1, wherein said removable laser module has a threaded outer surface and said second cavity has a threaded interior surface adapted to receive the threaded outer surface of said removable laser module.

6. The training barrel of claim 1, wherein said removable laser module does not protrude from the distal end of said barrel-shaped member.

7. The training barrel of claim 1, wherein the training barrel replaces a barrel of a pistol.

8. The training barrel of claim 1, wherein the training barrel is coupled with an upper receiver, said training barrel and said upper receiver replacing a barrel and upper receiver of a rifle.

9. The training barrel of claim 1, wherein said first cavity is sized to prevent chambering of a conventional blank cartridge or of a live round.

10. The training barrel of claim 1, wherein the training barrel and the blank cartridge are color coded to prevent mismatching of cartridges with said training barrel.

11. The training barrel of claim 1, further comprising:

an ultrasonic transmitter adapted to emit an ultrasonic acoustic signal simultaneously with the laser signal.

12. The training barrel of claim 1, wherein:

in an operational mode, said removable laser module emits a laser pulse in response to the mechanical wave sensed from the firing of the blank cartridge in said first cavity; and in a boresighting mode, said removable laser module emits a continuous laser beam to permit a direction of emission of said removable laser module to be boresighted with a longitudinal centerline of the firearm.

13. The training barrel of claim 1, wherein the laser signal is a modulated laser pulse, and wherein said training barrel corresponds to a target adapted to detect the modulated laser pulse.

14. The training barrel of claim 1, wherein the firearm fires the blank cartridge using one of: powder, compressed air, and carbon dioxide.

15. The training barrel of claim 1, wherein said removable laser module is held in said second cavity by frictional force between an outer surface of said removable laser module and an interior surface of said second cavity.

16. A detachable training barrel that replaces a conventional detachable barrel of a firearm to convert the firearm into a training device that emits a laser signal upon firing a blank cartridge, the training barrel comprising:

a barrel-shaped member defining a substantially cylindrical bore of the training barrel, with a proximal end and a distal end;

a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a laser module extending into said second cavity and comprising: a substantially cylindrical housing insertable into said second cavity; a mechanical wave sensor disposed within said housing and adapted to produce a trigger signal in response to a mechanical wave produced by firing the blank cartridge in said first cavity; a laser transmitter adapted to emit the laser signal in response to the trigger signal; and a power source supplying power to said mechanical wave sensor and said laser transmitter.

17. The training barrel of claim 16, wherein said laser module is substantially cylindrical and is concentric with said barrel-shaped member, such that said laser module emits the laser signal along a longitudinal centerline of the training barrel.

18. The training barrel of claim 16, wherein replacement of the conventional barrel with the training barrel, inclusive of said laser module, does not substantially affect holstering of the firearm.

19. The training barrel of claim 16, wherein said laser module lies substantially within said second cavity and protrudes from the distal end of said barrel-shaped member by no more than 1 cm in a longitudinal direction.

20. The training barrel of claim 16, wherein said laser module is removable from said second cavity.

21. The training barrel of claim 20, wherein said laser module has a threaded outer surface and said second cavity has a threaded interior surface adapted to receive the threaded outer surface of said laser module.

22. The training barrel of claim 16, wherein said laser module in permanently mounted within said second cavity.

23. The training barrel of claim 22, wherein said laser module does not protrude from the distal end of said barrel-shaped member.

24. The training barrel of claim 16, wherein the training barrel replaces a barrel of a pistol.

25. The training barrel of claim 16, wherein the training barrel is coupled with an upper receiver, said training barrel and said upper receiver replacing a barrel and upper receiver of a rifle.

26. The training barrel of claim 16, wherein:

said mechanical wave sensor includes at least one of: a piezoelectric element, an accelerometer, and a strain gauge;

said laser transmitter includes a lens and an optics package that projects the laser signal distally through the lens; and said power source comprises a button-shaped battery.

27. The training barrel of claim 16, wherein said first cavity is sized to prevent chambering of a conventional blank cartridge or of a live round.

28. The training barrel of claim 16, wherein the training barrel and the blank cartridge are color coded to prevent mismatching of cartridges with said training barrel.

29. The training barrel of claim 16, further comprising:

an ultrasonic transmitter adapted to emit an ultrasonic acoustic signal simultaneously with the laser signal.

30. The training barrel of claim 16, wherein:

in an operational mode, said laser module emits a laser pulse in response to the mechanical wave sensed from the firing of the blank cartridge in said first cavity; and in a boresighting mode, said laser module emits a continuous laser beam to permit a direction of emission of the laser module to be boresighted with a longitudinal centerline of the firearm.

31. The training barrel of claim 16, wherein the laser signal is a modulated laser pulse, and wherein said training barrel corresponds to a target adapted to detect the modulated laser pulse.

32. The training barrel of claim 16, wherein the firearm fires the blank cartridge using one of: powder, compressed air, and carbon dioxide.

33. A detachable training barrel that replaces a conventional detachable barrel of a firearm to convert the firearm into a training device that emits a laser signal upon firing a blank cartridge, the training barrel comprising:

a barrel-shaped member defining a substantially cylindrical bore of the training barrel, with a proximal end and a distal end;

a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said first cavity being sized to prevent chambering of a live round, said wall preventing forward discharge toward the distal end upon firing of the blank cartridge; and a laser module extending into said second cavity, said laser module emitting the laser signal in response to a mechanical wave sensed from the firing of the blank cartridge in said first cavity.

34. A detachable training barrel that replaces a conventional detachable barrel of a firearm to convert the firearm into a training device that emits a laser signal upon firing a blank cartridge, the training barrel comprising:

a barrel-shaped member defining a substantially cylindrical bore of the training barrel, with a proximal end and a distal end;

a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a laser module extending into said second cavity, said laser module emitting the laser signal in response to a mechanical wave sensed from the firing of the blank cartridge in said first cavity;

wherein the training barrel and the blank cartridge are color coded to prevent mismatching of cartridges with said training barrel.

35. A detachable training barrel that replaces a conventional detachable barrel of a firearm to convert the firearm into a training device that emits a laser signal upon firing a blank cartridge, the training barrel comprising:

a barrel-shaped member defining a substantially cylindrical bore of the training barrel, with a proximal end and a distal end;

a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge;

a laser module extending into said second cavity, said laser module emitting the laser signal in response to a mechanical wave sensed from the firing of the blank cartridge in said first cavity; and an ultrasonic transmitter adapted to emit an ultrasonic acoustic signal simultaneously with the laser signal.

36. A detachable training barrel that replaces a conventional detachable barrel of a firearm to convert the firearm into a training device that emits a laser signal upon firing a blank cartridge, the training barrel comprising:

a barrel-shaped member defining a substantially cylindrical bore of the training barrel, with a proximal end and a distal end;

a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a laser module extending into said second cavity, said laser module emitting the laser signal in response to a mechanical wave sensed from the firing of the blank cartridge in said first cavity, wherein;

in an operational mode, said laser module emits a laser pulse in response to the mechanical wave sensed from the firing of the blank cartridge in said first cavity; and in a boresighting mode, said laser module emits a continuous laser beam to permit a direction of emission of the laser module to be boresighted with a longitudinal centerline of the firearm.

37. A training firearm that fires a blank cartridge and emits a laser signal upon firing of the blank cartridge, said training firearm comprising:

a pullable trigger for initiating firing of the blank cartridge;

a training barrel having a substantially cylindrical bore with a proximal end and a distal end;

a solid wall extending transversely across the bore of said training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a removable laser module extending into said second cavity, said removable laser module emitting the laser signal in response to a mechanical wave sensed from he firing of the blank cartridge in said first cavity.

38. The training firearm of claim 37, wherein:

said training barrel is detachable from said training firearm; and said training firearm accommodates a conventional barrel permitting the training firearm to fire projectiles.

39. The training firearm of claim 37, wherein holstering of the training firearm with said training barrel is substantially the same as holstering of the training firearm with said conventional barrel.

40. The training firearm of claim 37, wherein said removable laser module is substantially cylindrical and is concentric with said training barrel, such that said laser module emits the laser signal along a longitudinal centerline of said training barrel.

41. The training firearm of claim 37, wherein said removable laser module lies substantially within said second cavity and protrudes from the distal end of said barrelshaped member by no more than 1 cm in a longitudinal direction.

42. The training firearm of claim 37, wherein said removable laser module has a threaded outer surface and said second cavity has a threaded interior surface adapted to receive the threaded outer surface of said removable laser module.

43. The training firearm of claim 37, wherein said removable laser module does not protrude from the distal end of said barrel-shaped member.

44. The training firearm of claim 37, wherein said removable laser module comprises:

a substantially cylindrical housing insertable into said second cavity;

a mechanical wave sensor disposed within said housing and adapted to produce a trigger signal in response to the mechanical wave produced by firing the blank cartridge in said first cavity;

a laser transmitter adapted to emit the laser signal in response to the trigger signal; and a power source supplying power to said mechanical wave sensor and said laser transmitter.

45. The training firearm of claim 37, wherein said first cavity is sized to prevent chambering of a conventional blank cartridge or of a live round.

46. The training firearm of claim 37, wherein the training firearm and the blank cartridge are color coded to prevent mismatching of cartridges with said training barrel.

47. The training firearm of claim 37, further comprising:

an ultrasonic transmitter adapted to emit an ultrasonic acoustic signal simultaneously with the laser signal.

48. The training firearm of claim 37, wherein the laser signal is a modulated laser pulse, and wherein said training firearm corresponds to a target adapted to detect the modulated laser pulse.

49. The training firearm of claim 37, wherein the training firearm fires the blank cartridge using one of: powder, compressed air, and carbon dioxide.

50. The training firearm of claim 37, wherein said removable laser module is held in said second cavity by frictional force between an outer surface of said removable laser module and an interior surface of said second cavity.

51. A training firearm that fires a blank cartridge and emits a laser signal upon firing of the blank cartridge, said training firearm comprising:

a pullable trigger for initiating firing of the blank cartridge;

a training barrel having a substantially cylindrical bore with a proximal end and a distal end;

a solid wall extending transversely across the bore of said training barrel and separating the bore into a first substantially cylindrical cavity extending inward from the proximal end and a second substantially cylindrical cavity extending inward from the distal end, said first cavity serving as a firing chamber and being adapted to receive the blank cartridge, said first cavity being sized to prevent chambering of a live round, said wall preventing forward discharge toward the distal end upon firing of the blank cartridge; and a laser module extending into said second cavity, said laser module emitting the laser signal in response to a mechanical wave sensed from the firing of the blank cartridge in said first cavity.

52. A training firearm that fires a blank cartridge and emits a laser signal upon firing of the blank cartridge, said training firearm comprising:

a pullable trigger for initiating firing of the blank cartridge;

a training barrel having a substantially cylindrical bore with a proximal end and a distal end;

a solid wall extending transversely across the bore of said training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a laser module extending into said second cavity, said laser module emitting the laser signal in response to a mechanical wave sensed from the firing of the blank cartridge in said first cavity;

wherein the training firearm and the blank cartridge are color coded to prevent mismatching of cartridges with said training barrel.

53. A training firearm that fires a blank cartridge and emits a laser signal upon firing of the blank cartridge, said training firearm comprising:

a pullable trigger for initiating firing of the blank cartridge;

a training barrel having a substantially cylindrical bore with a proximal end and a distal end;

a solid wall extending transversely across the bore of said training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge;

a laser module extending into said second cavity, said laser module emitting the laser signal in response to a mechanical wave sensed from the firing of the blank cartridge in said first cavity; and an ultrasonic transmitter adapted to emit an ultrasonic acoustic signal simultaneously with the laser signal.

54. A training firearm that fires a blank cartridge and emits a laser signal upon firing of the blank cartridge, said training firearm comprising:

a pullable trigger for initiating firing of the blank cartridge;

a training barrel having a substantially cylindrical bore with a proximal end and a distal end;

a solid wall extending transversely across the bore of said training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a laser module extending into said second cavity and comprising: a substantially cylindrical housing insertable into said second cavity; a mechanical wave sensor disposed within said housing and adapted to produce a trigger signal in response to a mechanical wave produced by firing the blank cartridge in said first cavity; a laser transmitter adapted to emit the laser signal in response to the trigger signal; and a power source supplying power to said mechanical wave sensor and said laser transmitter.

55. A training firearm that fires a blank cartridge and emits a laser signal upon firing of the blank cartridge, said training firearm comprising:

a pullable trigger for initiating firing of the blank cartridge;

a training barrel having a substantially cylindrical bore with a proximal end and a distal end;

a solid wall extending transversely across the bore of said training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge; and a laser module extending into said second cavity, said laser module emitting the laser signal in response to a mechanical wave sensed from the firing of the blank cartridge in said first cavity, wherein;

in an operational mode, said laser module emits a laser pulse in response to the mechanical wave sensed from the firing of the blank cartridge in said first cavity; and in a boresighting mode, said laser module emits a continuous laser beam to permit a direction of emission of the laser module to be boresighted with a longitudinal centerline of the firearm.

56. A laser firearm system for firearm competition or training involving firing a firearm toward a target without use of projectiles, the system comprising:

a training firearm having a trigger, a barrel and a laser transmitter module that emits a laser signal in response to a mechanical wave produced by pulling of the trigger and sensed by the laser transmitter module;

a laser-detecting target adapted to detect the laser signal and produce a laser detection signal;

a processor responsive to the laser detection signal for generating information indicating a hit location of the laser signal on said target;

a remotely-located laser-detecting target and processor; and a communication network linking said processor to said remotely-located processor.

57. The system of claim 56, wherein said laser-detecting target includes an array of laser light detectors adapted to detect the laser signal and to produce the laser detection signal.

58. The system of claim 56, wherein said laser transmitter module emits a modulated laser signal along a longitudinal centerline of the barrel in response to the mechanical wave produced by pulling of the trigger and sensed by said laser-detecting target.

59. The system of claim 58, wherein said laser-detecting target is configured to detect only laser signals modulated in the manner of said modulated laser signal.

60. The system of claim 58, wherein a modulation of the modulated laser signal identifies the training firearm emitting the modulated laser signal.

61. The system of claim 56, wherein pulling of the trigger causes firing of a blank cartridge that produces the mechanical wave.

62. The system of claim 56, wherein said training firearm comprises:

a conventional firearm; and a cylindrical laser module inserted into a barrel of the conventional firearm.

63. The system of claim 56, wherein said training firearm comprises a training barrel incapable of firing a projectile.

64. The system of claim 63, wherein said training barrel is a detachable training barrel that replaces a conventional detachable barrel of a firearm to convert the firearm into a training device that emits a laser signal upon firing a blank cartridge.

65. The system of claim 64, wherein said training barrel comprises:

a barrel-shaped member defining a substantially cylindrical bore of the training barrel, with a proximal end and a distal end; and a solid wall extending transversely across the bore of the training barrel and separating the bore into a first substantially cylindrical cavity extending inward from the proximal end and a second substantially cylindrical cavity extending inward from the distal end, said first cavity serving as a firing chamber and being adapted to receive the blank cartridge, said wall preventing forward discharge toward the distal end upon firing of the blank cartridge, the laser transmitter module extending into said second cavity and emitting the laser signal in response to the mechanical wave sensed from the firing of the blank cartridge in said first cavity.

66. The system of claim 56, wherein said training firearm is incapable of firing a projectile.

67. The system of claim 56, wherein said laser-detecting target is formed in the shape of a bull's eye.

68. The system of claim 56, wherein said laser-detecting target comprises a plurality of range-scaled targets.

69. The system of claim 56, further comprising:

an ultrasonic transmitter coupled to said training firearm and adapted to transmit an ultrasonic signal simultaneously with the laser signal;

an ultrasonic detector coupled to said laser-detecting target and adapted to detect an arrival time of the ultrasonic signal at said laser-detecting target;

wherein said processor determines a distance between said training firearm and said laser-detecting target from a time delay between an arrival time of the laser signal at said laser-detecting target and the arrival time of the ultrasonic signal.

70. The system of claim 56, wherein said processor determines a center of gravity of a group of laser signals sequentially detected by the laser-detecting target.

71. The system of claim 56, wherein said communication network includes a server linked to said first and second processors.

72. The system of claim 56, wherein:

said training firearm, said laser-detecting target and said processor are located at a first site, and said remotely-located laser-detecting target and processor are located at a second site; and said communication network includes a user interface permitting users at said first site to communicate with users at the second site.

73. The system of claim 72, wherein said user interface permits coordination of competition between users at said first site and users at said second site.

74. The system of claim 72, wherein said user interface permits viewing at said first site of target detection results from said second site.

75. The system of claim 72, wherein said user interface includes a web site.

76. The system of claim 56, wherein said communication network is a global communication network.

77. A laser firearm system for firearm competition or training involving firing a firearm toward a target without use of projectiles, the system comprising:

a training firearm including a trigger, a barrel and a laser transmitter module that emits a laser signal in response to a mechanical wave produced by pulling of the trigger and sensed by the laser transmitter module;

a laser-detecting target adapted to detect the laser signal and produce a laser detection signal:

an ultrasonic transmitter coupled to said training firearm and adapted to transmit an ultrasonic signal simultaneously with the laser signal;

an ultrasonic detector coupled to said laser-detecting target and adapted to detect an arrival time of the ultrasonic signal at said laser-detecting target; and a processor coupled to said laser detecting target and said ultrasonic detector, said processor being responsive to the laser detection signal for generating information indicating a hit location of the laser signal on said target, and determining a distance between said training firearm and said laser-detecting target from a time delay between an arrival time of the laser signal at said laser-detecting target and the arrival time of the ultrasonic signal.

78. The system of claim 77, wherein the system prevents cheating caused by locating said training firearm improperly close to said laser-detecting target by reporting the distance between said training firearm and said laser-detecting target together with the information indicating the hit location.

79. A laser firearm system for firearm competition or training involving firing a firearm toward a target without use of projectiles, the system comprising:

a training firearm including a trigger, a barrel and a laser transmitter module that emits a laser signal in response to a mechanical wave produced by pulling of the trigger and sensed by the laser transmitter module;

a laser-detecting target adapted to detect the laser signal and produce a laser detection signal; and a processor responsive to the laser detection signal for generating information indicating a hit location of the laser signal on said target, wherein said processor determines a center of gravity of a group of laser signals sequentially detected by the laser light detectors.

* * * * *